United States Patent [19]

Hartka

[11] 3,949,980

[45] Apr. 13, 1976

[54] METERING MEANS FOR BLANKS

[75] Inventor: Theodore J. Hartka, Phoenix, Md.

[73] Assignee: Wm. C. Staley Machinery Corporation, Hunt Valley, Md.

[22] Filed: Nov. 25, 1974

[21] Appl. No.: 527,052

[52] U.S. Cl. ..... 271/134; 271/166

[51] Int. Cl.[2] ..... B65H 1/24

[58] Field of Search ..... 271/3.1, 35, 134, 136, 271/165, 166, 171, 131, 132, 133, 144

[56] References Cited

UNITED STATES PATENTS

| | | | |
|---|---|---|---|
| 1,218,034 | 3/1917 | Young | 271/166 |
| 1,394,613 | 10/1921 | Drury | 271/166 |
| 3,726,454 | 4/1973 | Robbins | 271/166 |

*Primary Examiner*—John J. Love
*Assistant Examiner*—Robert Saifer
*Attorney, Agent, or Firm*—Shanley, O'Neil & Baker

[57] ABSTRACT

A machine for handling corrugated paper blanks and the like is shown having an adjustable back stop means to cooperate with infeed means to regulate the flow of blanks going into the machine to be processed to ensure proper feeding of the blanks serially to the gate to be passed onwardly. The adjustable infeed device is positioned before the infeed gate to control the dropping of the blanks onto the feed table, in a manner to continuously maintain a desired limited number of blanks on the table of the machine in position between the back stop and a front wall means in front of the gate as the blanks are fed one by one from the bottom of the pile through the gate.

10 Claims, 4 Drawing Figures

METERING MEANS FOR BLANKS

PRIOR ART

Many devices are known for feeding blanks of various kinds from the bottom of a stack held on a feed table so the blanks can be moved one after the other through a feed gate into processing means. In the paper handling arts, a number of different arrangements have been proposed. Typical feeding means for handling paper cards and corrugated blanks are shown in the U.S. Pat. to Dixon, Nos. 2,827,290, Mar. 18, 1958; 3,096,087 to Markley, July 2, 1963; and 3,105,681 to Bishop et al, Oct. 1, 1963.

The present invention is concerned particularly with an apparatus for feeding blanks to creasing, folding or other processing means for operating on blanks formed from a corrugated paper type of material and other larger sizes of blanks which must be manipulated even though they may not all be uniform, as for example, when certain of the blanks may be warped. The Bishop patent proposes one solution to this problem while the present invention provides improved procedure for applying increased pressure to the leading edge of the blank being fed while also more positively controlling the number of blanks maintained in the infeed pile of the feed table of the machine.

BRIEF DESCRIPTION OF THIS INVENTION

The feeding apparatus here shown is adapted to support a large stack of blanks to be processed in position over the infeed table so that the blanks can be dropped one at a time from the bottom of the stack into a pile of from about 3 to 6 blanks on the feed table to be fed serially into the machine. The main body of the stack is held in an inclined position in the infeed hopper with the leading edges of all of the blanks in contact with each other and engaged against the front wall of the hopper. The following or trailing ends of the blanks are supported on top of a metering strip spaced somewhat above the infeed table. The metering strip is used in association with the back stop structure on the feed table which coacts with the trailing ends of the blanks. The blanks in the stack are held in an inclined position by the back stop means which holds the trailing ends somewhat higher than the leading edges and because the front or leading edges of the blanks including the 3 to 6 blanks in the pile dropped onto the feed table are all in contact with each other the weight of the entire stack tends to push the leading edge of the lowermost blank in the stack firmly against the top surface of the infeed table adjacent the infeed gate. The gate is located just below the front wall of the hopper and permits only the bottom blank in the pile on the feed table to be fed from the feed table through the gate and on to the processing machine.

The position of the metering strip relative to the surface of the table, the front wall and the gate is critical in order to cause a proper blank dropping action to take place. It is the functioning of the metering strip to control the dropping of the blanks serially through the metering lip. This is accomplished by the precise positioning of the metering lip which sometimes must be changed during a run of blanks due to the presence of slightly warped blanks in the stack. When the metering strip is positioned properly, and blanks are being processed, the metering strip will project slightly forwardly of the plane of the face of the back stop members, to be positioned closer to the front wall of the hopper. When so positioned, it is operative to maintain a supply of about 3 to 6 or any desired number of blanks in a pile on the feed table. To do this, the distance between the front of the hopper wall and tip or the front end of the metering strip should be slightly less than the length of the blanks in the stack. When the front or leading edges of the blanks in the main stack rest on top of the leading edges of the 3 to 6 blanks that are bottom most in the composite stack and form the measured pile of blanks resting on the feed table, as large as possible a part of the weight of the stack is concentrated on the leading edge of the very lowermost blank in contact with the upper surface of the feed table in order to help the known vacuum means associated with the underside of the table to positively hold it flat or straightened out so that the blank can be fed through the gate without any part of the leading edge of that blank being tripped by the gate.

When the lowermost blank has been pushed from under the pile on the feed table and through the gate, the front edges of all the blanks in the feed hopper drop down a distance equal to the thickness of a blank. Due to the inclined position of the blanks supported on the edge of the metering strip, the dropping action causes the first blank engaged on top of the metering edge to fall freely past the edge to become the top blank in the small pile of blanks on the feed table while the rest of the blanks in the infeed stack come to rest with their leading edges in contact with the front wall and their trailing edges supported over the metering lip.

As the blanks are fed one by one from under the pile on the feed table, the blanks are metered out one by one from the main stack and their rear edges drop one by one past the metering strip to permit the blanks to fall onto the controlled number of blanks forming the pile on the feed table in front of the back stop means.

If a warped group of blanks must be metered in this manner, it is apparent that the effective length of the blanks changes. In this instance, while the position of the gate and back stop must remain constant because their relative positions are determined by the actual length of the blank being processed. The metering strip must be adjusted to meet this apparent foreshortening of the length of the blanks in the stack over the metering strip. The construction here provided makes this adjustment of the metering lip possible without changing the position of the front wall over the gate or the backstop means whereby to continue the one by one dropping of the blanks onto the feed table.

It is therefore an object of this invention to provide an improved metering means for use with flat sheet feeding means.

Another object is to provide an adjustable metering strip means for use on a corrugated paper blank feeding mechanism.

Another object is to provide a metering strip support means for use on machines for handling corrugated paper blanks that can be adjusted relative to the back stop means to provide a more versatile feeding system.

Other objects will appear from the specification below:

IN THE DRAWINGS

DETAILED DESCRIPTION

Figure 1:
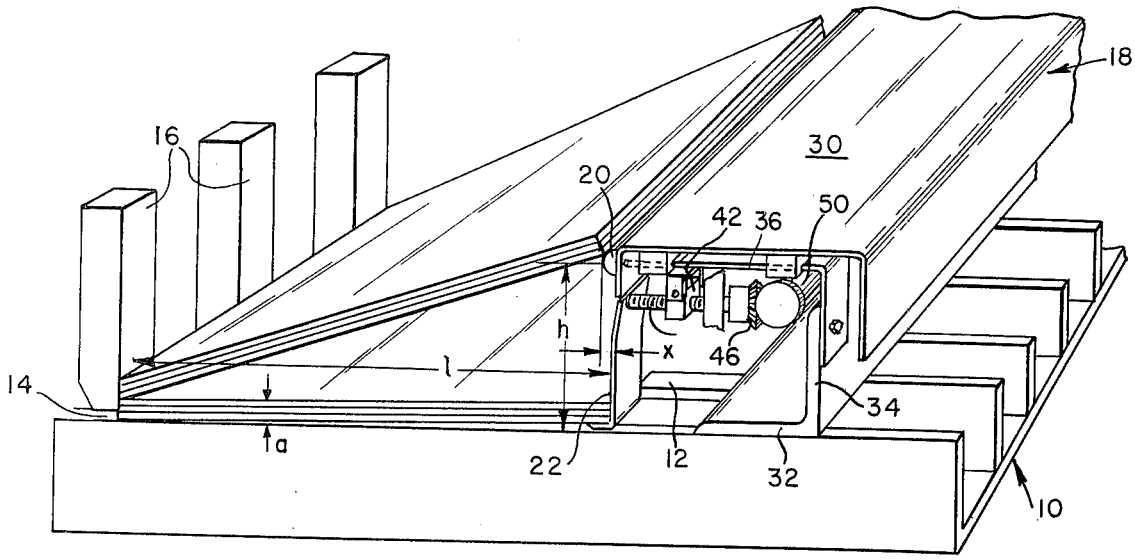
FIG. 1 is a perspective showing the general arrangement of the structure of this invention relative to the feed table of a processing machine.

The general arrangement of the corrugated paper blank feeding apparatus of this invention is shown in FIG. 1 wherein a feed table 10 is equipped with known vacuum means for flattening blanks against its upper surface. The feed table is positioned relative to the infeed means, to receive the blanks on its top side to be pushed by reciprocating pusher 12 to be fed one by one through gate 14. In the view shown, three blanks have been measured off and dropped in a pile supported on the feed table in position between a front wall 16 and a back stop means generally referenced 18, and the remainder of the stack of blanks is supported in a sloping inclined position with their leading or front ends in contact with the wall 16 and also in contact with each other and resting upon the edges of the blanks previously dropped onto the feed table. The trailing ends of the remainder of the stack of blanks are supported on the bottom most blank that is in engagement with the nose 20 of the rounded metering strip.

The position of the metering strip relative to the feed table and the front wall 16 is critical to the proper feeding of blanks from said remainder of the stack to the smaller pile supported immediately on the feed table. It is seen from an inspection of FIG. 1, when the several elements are positioned as there shown, that as the lowermost blank supported on the feed table is fed through gate 14, that the height "a" of the pile on the feed table is reduced by an amount equal to the thickness of the blank that has been fed from under the pile. When this happens, the front edges of the entire stack situated above the feed table moves down a distance equal to one thickness. The rear end of the lowermost blank supported on the metering strip can now pass over the nose 20 to permit that single blank to fall onto the measured pile lying on the feed table. The next following blank will then drop to the position where its leading edge is supported against the front wall at the full height "*a*" above the table so that its trailing edge cannot pass the tip end of the metering strip.

In the preferred operation of this type of feeding mechanism the elements forming the front wall 22 of the back stop means fall in a plane spaced away from and disposed about parallel to the plane of the front wall 16. The two planar surfaces are spaced apart along the surface of the feed table 10, a distance "*l*" equal to about the length of a blank when laid flat on the table. It is conventional to provide suitable vacuum means which are not shown herein, to hold the bottom most blank flat against the surface of the table while it is being pushed through the feed gate. The nose of the metering strip is normally positioned a distance "*x*" in front of the plane that includes the face of the back stop means and the tip or the nose is situated above the surface of the feed table a distance "*h*".

As long as flat blanks are being fed, the mechanism shown in FIG. 1 can be operated quite satisfactorily to feed blanks through the gate 14 one by one to the processing machine. It should be noted, that depending upon the distance the nose of the metering strip is adjusted toward or away from the front wall, a fewer or larger number of blanks will be deposited in the measured pile on the feed table. When the nose is spaced closer to the front wall the dimension *a* is relatively short and fewer blanks are in the measured pile maintained on the table and conversely, when nose 20 is moved away from wall 16 and the inclination of the stack is reduced, the dimension *a* is greater and more blanks constitute the measured pile on the top of the feed table. In normal practice, an adjustment is provided from a position where the nose 20 of the metering strip is directly over the back stop wall to any position including a position where the nose is 1 and ⅛ inch or even closer to the front wall. The above describes the operation when flat blanks are available, at other times, warped blanks are encountered and must be fed one at a time to be processed. The present invention provides a means whereby by suitable adjustment, this feed means can be made to accommodate such a situation. The independent adjustability of the metering strip relative to the front wall and back stop makes it possible to feed warped blanks one at a time to produce a measured pile on the feed table.

It will be noted if a warped blank is placed in the stack with the convex side facing downwardly, and with its leading edge against wall 16 and in contact with the leading edges of all the blanks below it, there is a relative foreshortening of the length of blank due to its being warped so that measuring lip 20 must be moved closer to wall 16. To avoid the improper feeding of the warped blanks, the nose 20 of the metering strip can be adjusted closer to wall in accordance with this invention to eliminate the effect of the foreshortening of the blank due to warping, so that the warped blank will be properly supported with just the right distance between the metering strip and front wall to permit the desired pile of foreshortened (warped) blanks to be fed one by one to the feed table as the blanks in the pile on the feed table are fed one by one to the processing machine. It is obvious that when the warped blank falls onto the infeed table, the suction means associated therewith causes the blank to lie flat on the table and the warp is eliminated and therefore the back stop wall 22 must be left in its original position, a distance *l* away from front wall 16. However, by adjusting the position of the metering lip closer to wall 16 and independently of the position of the back stop 18, a controlled rate of feeding can be accomplished to maintain the desired number of blanks in the measured pile on the table.

Figure 2:
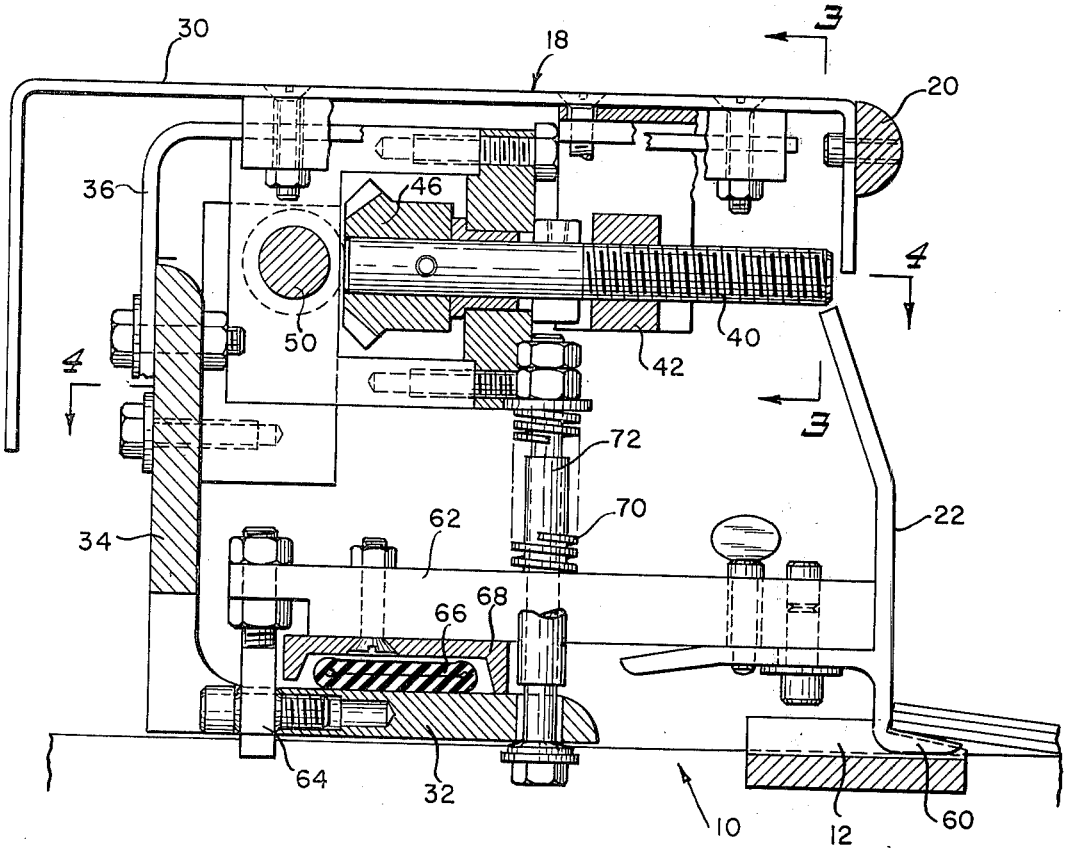
FIG. 2 is a sectional side elevation showing the details of the metering strip mounting and adjusting mechanism.
Figure 3:
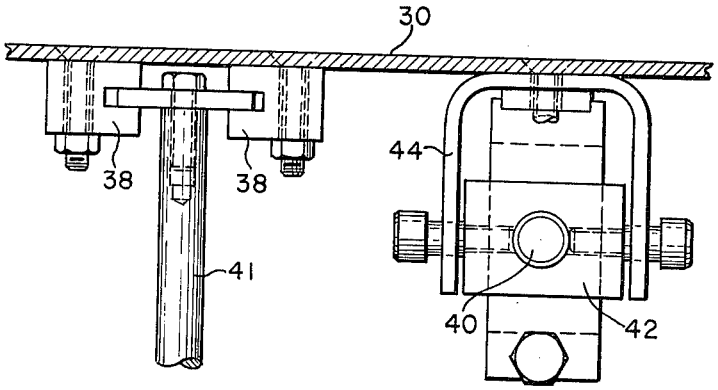
FIG. 3 is a view looking along line 3—3 of FIG. 2.
Figure 4:
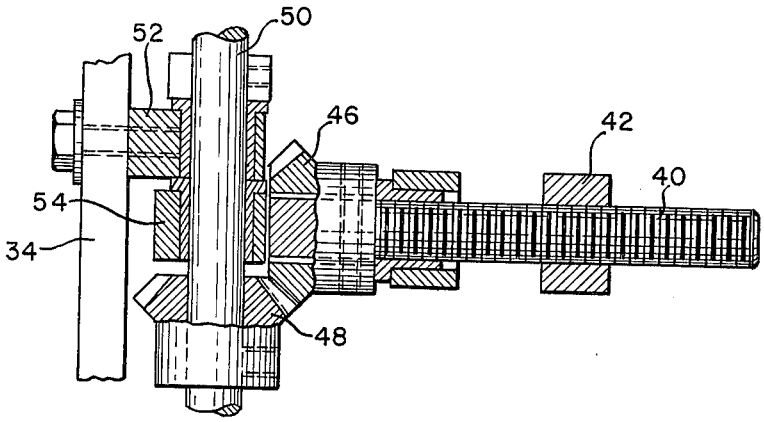
FIG. 4 is a view looking along line 4—4 of FIG. 2.

The structure for mounting the metering strip on the feeding device for the required independent adjustment is best shown in FIGS. 2, 3, and 4. In the preferred embodiment, the metering strip 20 forms the nose of a movable rest element 30 that extends over a base or support for the back stop in the form of an angle iron element that has a horizontal web 32 and a vertical web 34. The angle iron may extend across the back end of the feed table at a right angle to the direction of feed movement and provided with conventional adjusting means (not shown) for moving the back stop means on the table for setting the back stop a distance "*l*" away from front wall 16.

The movable rest element 30 is supported for sliding movement on L shaped bearing rods 36 the toes of which are bolted at spaced points along the length of the web 34. A plurality of slide bearing blocks 38 fixed to the underside of the movable rest 30 guide the horizontal sliding of the movable rest on the several slide bearings 36. The horizontal run of each of the bearing means 36 is fixedly supported on vertical studs 41 shown in FIG. 3 that are supported at their lower ends on web 32.

The motion of the movable rest along bearings 36 is controlled by any suitable means. Either a single drive or preferably the rest 30 is adjusted by the rotation of the pair of laterally spaced apart screw adjusting shafts 40 that coact with a plurality of nuts 42. Each of the nuts 42 is suspended from the underside of the movable rest in a bracket 44 best seen in FIG. 3 attached to the underside of the rest. The screw shafts 40 are rotated in the nuts by means of the mitre gear drive means 46, and 48 shown in FIG. 4 wherein a gear 46 is shown pinned to each of the shafts 40 and each of the gears 48 is pinned to drive shaft 50 in a position to cooperate with one of the mitre gears 46. The drive shaft 50, is rotatably carried in several spaced apart bearing means 52 bolted to web 34. Each of the driven screw shafts 40 is supported on one end in a bearing bracket 54 carried on shaft 50 and the other end is carried in the nut 42 that cooperates with the threaded end of screw shaft 40. The adjusting shaft 50 extends laterally across the back stop means from one end to the other of the angle iron base and hand wheels may be keyed to either one or both ends of the shaft for driving the mitre gears to move the movable rest to the right or left as viewed in FIG. 2.

The elements 22 forming the back wall of the hopper for the blanks on the back stop means are supported from the angle iron web 32. The vertical wall 22 of each of the several back stops has a rearwardly sloping section for guiding the falling blanks into position in front of wall 22 and onto the integral toe 60 which supports the blank until the reciprocating drive means 12 engages the rear edge of the lowermost blank to drive it through gate 14.

Each of the wall elements 22 and toe 60 are mounted on the end of pivot arm 62 that is carried at its opposite end on the spherical bearing 64. Bearings 64 are mounted on the web element 32 of the angle iron and an air bag 66 is positioned under arm 62 forwardly of bearing 64 to engage against the lifting plate 68 to raise all of the arms 62 when it is inflated to lift the lowermost blank carried on toes 60 out of position to be engaged by the drive means 12 when further feed of the blanks is to be cut off. When feed is to be resumed, the air pressure supply is cut off and springs 70 carried on the upper end of bolts 72 push arms 62 down to their operative positions to place the blanks in front of the pusher 12. Such mechanism for controlling position of the back stop means is conventional to render the feed operative or inoperative as desired.

Normally as above indicated, the metering strip is adjusted so that its tip is outwardly from the plane of the faces 22 of the back stop means. It can be adjusted forwardly to accommodate warped blanks or to change the number of blanks being fed to the measured pile maintained on the face of the feed table. The device here disclosed serves to concentrate as much of the weight of the stack as possible on the leading edge of the bottom sheet or blank to be fed through the gate in order to help the vacuum on the feed table, to ensure that the leading edge of the blank will pass under the lower edge of the front wall and through the gate 14.

The operation of this mechanism has been described above. Preferably, the back stop is positioned a distance $l$ away from the gate (the length of the blank or sheet) and height $a$ of the pile of blanks on the feed table is equal to the thickness of six blanks when conventional forms of corrugated paper blanks are being processed. As above explained, the dimension $a$ can be maintained even when warped sheets are being fed through the machine with their bowed sides down, by adjusting the movable rest toward the front wall or gate of the feed hopper. By making the dimension $x$ adjustable to fit the real or foreshortened length of a blank while fixing the relative position of the back stop relative to the gate to be equal to the real length of the blanks, the dimension $a$ can be maintained at an optimum. The position of the movable rest 30 can easily be changed, even while the machine is running to maintain the proper number of sheets in the measured pile on the feed table to maintain preferred dimension $a$.

The adjustable metering strip is particularly adapted for use with sheets that are flat or warped concave up, i.e. sheets where both ends turn up and away from the feed table. When sheets are warped concave down, i.e. the sheets that have both ends turned down toward the feed table, some jamming may result if an attempt is made to use the metering strip in the manner described above. To obviate this possibility, the movable rest should be retracted until the dimension $x$ is zero and the nose of the strip is directly over the vertical wall of the back stop. When this adjustment is made, concave down sheets can be processed as in known machines without the metering means to maintain a measured pile on the feed table. The entire stack, in this last instance is supported directly on top of the feed table.

In the disclosure shown in the drawings, the front wall 16 is shown as having a planar surface extending upwardly from the surface of the feed table at about a right angle. In some machines, the gate has a tapered face so that the upper portion of the front wall 16 is closer to the back stop than the lower portion at the top of the gate. This slightly complicates the feeding geometry but does not interfere with the ultimate control of the feeding process for maintaining the measured pile.

While the above describes the preferred form of my invention, it is possible that modifications thereof may occur to those skilled in the art that will fall within the scope of the following claims.

What is claimed is:

1. In apparatus for feeding cardboard blanks one by one from the bottom of a stack of blanks through a gate means, an assembly supported above blank supporting structure, said assembly comprising front wall means positioned above said supporting structure leaving a gap that forms gate means, reciprocated feed means for engaging the trailing end of each blank when it is lowermost in the stack and feeding such blank into the gate means, backstop means, said backstop means including metering lip means to serially engage the trailing end of each of the blanks to provide a pile of blanks on the supporting structure and support the remainder of the stack in sloping inclined position to concentrate the weight of the stack on the leading end of the lowermost blank, means for adjustment of said lip means toward and away from said front wall means independently of the position of said backstop means to accommodate the feeding of either flat or warped blanks in a controlled manner to maintain a measured pile of blanks on the supporting structure.

2. A structure as in claim 1 wherein manually operable means are provided to effect the desired adjustment of the lip means.

3. A structure as in claim 1 wherein the backstop means includes a support means which is mounted on said supporting structure for additional adjustment toward and away from said front wall means.

4. In apparatus for feeding cardboard blanks one by one from the bottom of a stack of blanks through a gate means, an assembly supported above blank supporting structure, said assembly comprising front wall means positioned above said supporting structure leaving a gap that forms gate means, feed means for engaging one end of the lowermost blank in the stack, backstop means, said backstop means including adjustable metering lip means to serially engage said one end of each of the blanks as it moves downwardly toward said supporting structure, said backstop means including wall means, said backstop means including support means, said support means being adjustable toward and away from the front wall means defining the gate means to position the wall means of the backstop means away from said front wall means defining the gate means a distance about equal to the length of the blanks being fed, said support means including longitudinal slide bearing means, means for sliding engagement on said slide bearing means, selectively operable drive means to cause said metering lip means to move toward and away from the front wall means defining the gate means independent of the adjustment of the support means to accommodate the feeding of either flat or warped blanks in a controlled manner to maintain a measured pile of blanks on the blank supporting structure.

5. A structure as in claim 4 wherein said support means includes rigid structural means comprising an element having two webs disposed at right angles to each other, the wall means of the backstop means being supported on one of said webs and the metering lip means being supported on both of said webs.

6. A structure as in claim 5 wherein the wall means of the backstop means includes a plurality of walls spaced apart in the cross-machine direction.

7. A structure as in claim 6 wherein each wall of the plurality of walls of the wall means of the backstop means extends at about a right angle upwardly from the plane of the top surface of the blank supporting structure, and all the walls of the plurality of walls are substantially in the same plane, and said metering lip means is moveable in a direction parallel to the plane of the top surface of the blank supporting structure from an adjusted position in line with the plane of said walls of said backstop means to an adjusted position closer to said front wall means.

8. A structure as in claim 4 wherein the wall means of the backstop means has a wall extending at about a right angle upwardly from the plane of the top surface of the blank supporting structure and the metering lip is moveable from an adjusted position in line with the wall of the wall means of the backstop means to an adjusted position closer to said front wall means.

9. A structure as in claim 8 wherein said support means includes rigid structural means comprising an element having two webs disposed at right angles to each other, the wall means of the backstop means being supported on one of said webs and the metering lip means being supported on both of said webs.

10. A structure as in claim 9 wherein the wall means of the backstop means includes a plurality of walls spaced apart in the cross-machine direction.

* * * * *